US011640130B2

(12) United States Patent
Nakashima

(10) Patent No.: US 11,640,130 B2
(45) Date of Patent: May 2, 2023

(54) HEATING UNIT, FIXING UNIT, AND IMAGE FORMING APPARATUS FOR HEAT GENERATION PERFORMANCE AND MINIATURIZATION

(71) Applicant: CANON KABUSHIKI KAISHA, Tokyo (JP)

(72) Inventor: Yusuke Nakashima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 17/359,140

(22) Filed: Jun. 25, 2021

(65) Prior Publication Data

US 2021/0405561 A1 Dec. 30, 2021

(30) Foreign Application Priority Data

Jun. 30, 2020 (JP) ..... JP2020-112790

(51) Int. Cl.
*G03G 15/20* (2006.01)
*G03G 15/00* (2006.01)

(52) U.S. Cl.
CPC ..... *G03G 15/2057* (2013.01); *G03G 15/2064* (2013.01); *G03G 15/80* (2013.01)

(58) Field of Classification Search
USPC ..... 399/328
See application file for complete search history.

(56) References Cited

U.S. PATENT DOCUMENTS

2005/0280682 A1* 12/2005 Kato ..... G03G 15/2042 347/102
2020/0310308 A1* 10/2020 Jinkoma ..... G03G 15/2021

FOREIGN PATENT DOCUMENTS

| | | | | | |
|---|---|---|---|---|---|
| JP | H0916009 | A | | 1/1997 | |
| JP | H0996982 | A | | 4/1997 | |
| JP | H10275671 | A | | 10/1998 | |
| JP | 2004085698 | A | * | 3/2004 | ..... G03G 15/2064 |
| JP | 2005032455 | A | * | 2/2005 | ..... G03G 15/2064 |
| JP | 2020149832 | A | | 9/2020 | |

* cited by examiner

*Primary Examiner* — Quana Grainger
(74) *Attorney, Agent, or Firm* — Canon U.S.A., Inc. I.P. Division

(57) ABSTRACT

A heating unit includes a board including metal, an insulating layer including insulating material and formed on a surface of the board, a heating element disposed on the insulating layer to generate heat by passing an electric current through the heating element, and a conductive portion electrically connecting the heating element and the board to each other. The heating unit further includes a first power supplying electrode electrically connected to the heating element and a second power supplying electrode electrically connected to the board. The heating element, the conductive portion and the board constitute an electric circuit between the first power supplying electrode and the second power supplying electrode. The heating element generates the heat in a case where the first power supplying electrode and the second power supplying electrode are electrically connected to a power source and the electric current is passed through the electric circuit.

10 Claims, 7 Drawing Sheets

HEATING UNIT, FIXING UNIT, AND IMAGE FORMING APPARATUS FOR HEAT GENERATION PERFORMANCE AND MINIATURIZATION

BACKGROUND

Field

This disclosure relates to a heating unit for use in heat fixing of an image, a fixing unit including the heating unit, and an image forming apparatus including the fixing unit.

Description of the Related Art

In an image forming apparatus such as an electrophotographic printer, a copier, and a multifunction printer (MFP), a heat fixing type fixing unit is mounted. The fixing unit heats a toner image, which is transferred on a recording material, to fix the toner image to the recording material. As the fixing unit, a unit which includes a heater (heating unit) having a pattern of a resistance heating element formed on a board of a ceramic material, a fixing film rotating while sliding on the heater, and a pressing roller forming a nip portion with the heater therebetween across the fixing film is known. Japanese Patent Laid-Open No. H10-275671 describes a heater for use in the fixing unit which adopts a metal board having a higher strength against thermal stress than common ceramic materials.

Incidentally, to achieve an increased printing speed and an energy saving of the image forming apparatus, improvement in heat generation performance of the fixing heater is required. However, necessity to provide a countermeasure, such as thickening pattern widths of the resistance heating element and a conductor pattern, which supplies electricity to the resistance heating element, to prevent the resistance heating element and the conductor pattern from breakage due to overheating causes difficulties in miniaturizing the heater.

SUMMARY

The present disclosure provides a heating unit, a fixing unit and an image forming apparatus that can achieve both ensuring heat generation performance and miniaturization.

According to an aspect of the present disclosure, a heating unit includes a board including metal, an insulating layer including insulating material and formed on a surface of the board, a heating element disposed on the insulating layer and configured to generate heat by passing an electric current through the heating element, a conductive portion electrically connecting the heating element and the board to each other, a first power supplying electrode electrically connected to the heating element, and a second power supplying electrode electrically connected to the board, wherein the heating element, the conductive portion and the board constitute an electric circuit between the first power supplying electrode and the second power supplying electrode, and wherein the heating element is configured to generate the heat in a case where the first power supplying electrode and the second power supplying electrode are electrically connected to a power source and the electric current is passed through the electric circuit.

Further features of the present disclosure will become apparent from the following description of exemplary embodiments with reference to the attached drawings.

DESCRIPTION OF THE EMBODIMENTS

Hereinafter, embodiments of this disclosure will be described with reference to attached drawings.

First Embodiment

Figure 1A:
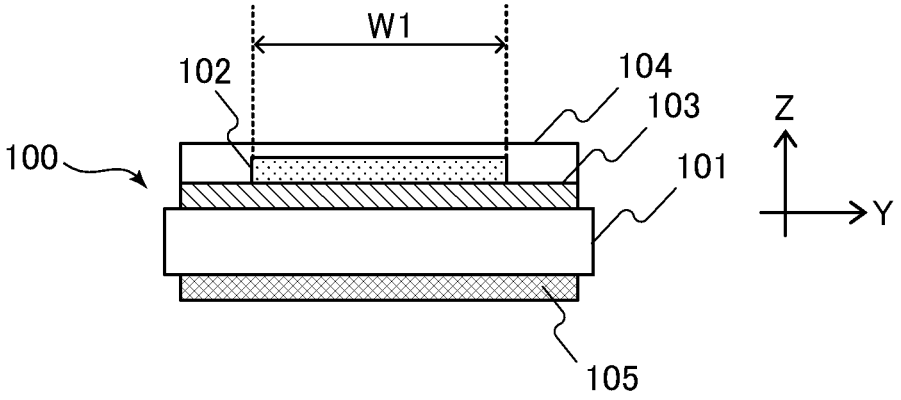
FIGS. 1A, 1B, and 1C are respectively a cross-sectional view in a short direction, a plan view, and a cross-sectional view in a longitudinal direction of a heater according to a first embodiment.
Figure 1B:
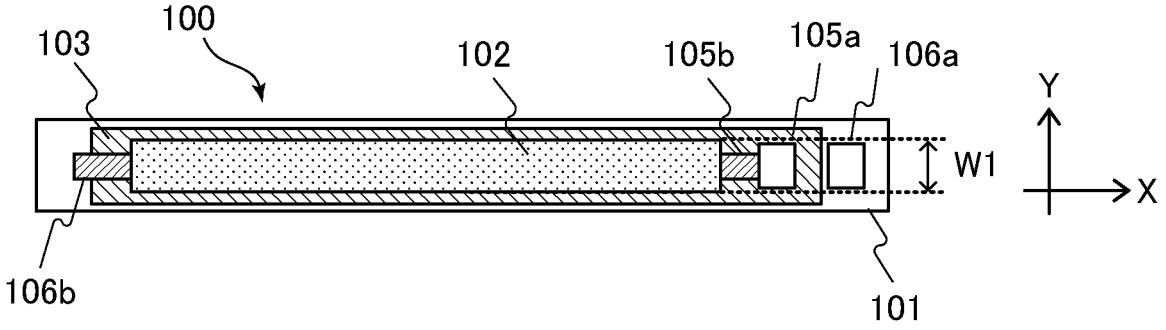
Figure 1C:
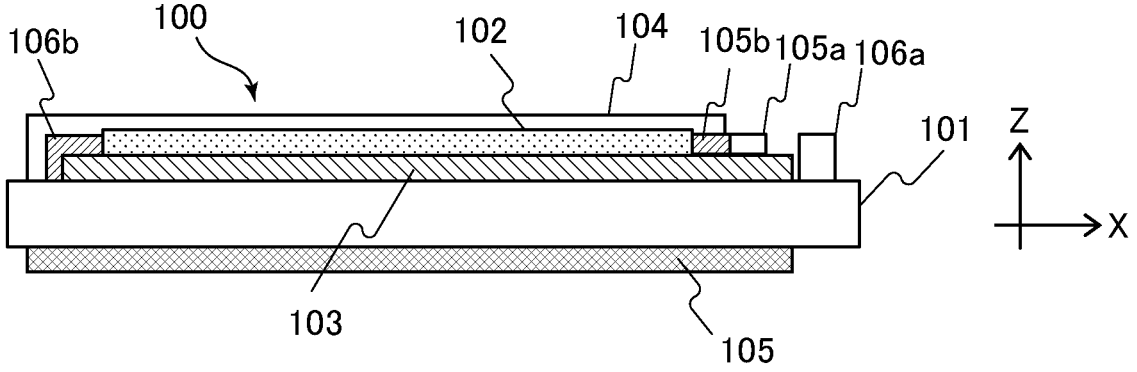

FIGS. 1A to 1C are schematic views showing a configuration of a heater 100 serving as a heating unit for a fixing unit according to a first embodiment of this disclosure.

In the following descriptions, a direction along the longest side of a board constituting the heater 100 is referred to as a longitudinal direction X of the heater 100. The longitudinal direction X is also a direction perpendicular to a conveyance direction of a recording material in the fixing unit, a longitudinal direction of a nip portion of the fixing unit, and a main scanning direction in an image forming operation. Among directions perpendicular to the longitudinal direction X of the heater 100, a representative direction along a principal surface of the board is referred to as a short direction Y of the heater 100. The principal surface is a surface on which a heating element is disposed. Further, a direction perpendicular to the longitudinal direction and the short direction (i.e., a normal direction of the principal surface of the board) is referred to as a thickness direction Z of the heater 100.

Layer Structure of Heater

FIG. 1A is a cross-sectional view of the heater 100 taken along a virtual plane spreading in the short direction Y and thickness direction Z, and viewed in the longitudinal direction X. FIG. 1B is a plan view of the heater 100, when viewed from a side, in the thickness direction Z, on which a heating element 102 is disposed. FIG. 1C is a cross-sectional view of the heater 100 taken along a virtual plane spreading in the longitudinal direction X and thickness direction Z, and viewed in the short direction Y.

As shown in FIGS. 1A to 1C, the heater 100 includes a board 101 having an elongated plate shape made of a metal or an alloy at least as a chief material and the heating element 102, serving as a heating layer generating heat by passing an electric current therethrough. The board 101 is a metal substrate. The heater 100 further includes an insulating layer 103 insulating the heating element 102 and the board 101, and a protective layer 104 protecting the heating element 102. Further, so as to prevent a warpage of a base material for the board 101 at manufacturing, the heater 100 includes an insulating layer 105 also on a surface of the board 101 opposite to the surface on which the heating element 102 is disposed.

As a material for the board 101, stainless steel, nickel, copper, aluminum, or alloy using these metals as the chief material are suitably used. Among these, the stainless steel is preferred in view of strength, a heat resisting property, and corrosion. A type of stainless steel is not limited, and it is acceptable to appropriately choose the type considering such as required mechanical strength, a linear expansion coefficient tailored to formation of the insulating layers 103 and 105 and the heating element 102 described below, and easiness of procurement of a plate in a market. To cite an example, martensitic or ferritic chromium-based stainless steel (400 series stainless) have a relatively low linear expansion coefficient even in stainless steel, and are suitably used because of easiness in the formation of the insulating layers 103 and 105 and the heating element 102.

A thickness of the board 101 is determined considering the strength, a heat capacity, and a heat radiation performance. In a case where the thickness of the board 101 is small (that is, thin), since the heat capacity is small, it is favorable to a quick start performance, but issues such as a distortion at calcination of the heating element 102 easily occurs if the thickness is too thin. On the other hand, in a case where the thickness of the board 101 is large (that is, thick), it is favorable in respect of the distortion at the calcination of the heating element 102, but unfavorable to the quick start since the heat capacity is large if the thickness is too thick. In considering of a balance of mass productivity, a cost, and a performance, the preferred thickness of the board 101 is 0.2 to 2.0 mm. To be noted, the quick start performance indicates a shortness of a time required for increasing a temperature, when the heating of the heater 100 is started in a state where the image forming apparatus is in a stand-by or power OFF state not performing the image forming operation, to a proper value for a heat fixing so that it becomes possible to perform an image forming operation.

While a material for the insulating layers 103 and 105 and the protective layer 104 is not particularly limited, it is necessary to choose an insulating material having a heat resistance in view of an actual use temperature. As the material, glass and PI (polyimide) are preferred in consideration of the heat resistance, and, in a case of the glass, it is acceptable to particularly choose a powder material suitably within a range which does not hamper characteristics of this embodiment. When necessary, it is also acceptable to mix a thermally conductive filler and the like having an insulation property.

Either the same or different material(s) is/are used for the insulating layer 103, the protective layer 104, and the insulating layer 105. Regarding thicknesses of the insulating layers 103 and 105 and the protective layer 104, similarly, it is acceptable to adopt either the same thickness or the thicknesses different to each other as necessary. When an insulating layer of the glass and PI (polyimide) is formed on a surface of the board 101, it is preferred to properly adjust the linear expansion coefficients of the board and the insulating material so that neither a crack nor a peeling occurs on the insulating layer due to differences in the linear expansion coefficients between the materials.

Composition of Heating Element

The heating element 102 is calcinated after printing a heating resistor paste mixed with (A) a conductive component, (B) a glass component, and (C) an organic binder component on the insulating layer 103. Since, when the heating resistor paste is calcinated, the organic binder component (C) is burned off and the components (A) and (B) remained, so that the heating element 102 containing the conductive component and the glass component is formed.

As the conductive component (A), a silver and palladium alloy (Ag—Pd), ruthenium oxide ($RuO_2$), and the like are used alone or in combination, and a suitable sheet resistance is 0.1 Ω/sq (ohms per square) to 100 kΩ/sq. Further, it is acceptable to include a very small quantity of a material other than (A) to (C) above to an extent that does not hamper the characteristics of this embodiment.

Configuration of Power Supplying Electrode and Conductor Pattern

Next, a circuit configuration so as to passing an electric current to (i.e., to energize) the heating element 102 in the heater 100 will be described. As shown in FIGS. 1B and 1C, the heater 100 includes power supplying electrodes 105*a* and 106*a* and conductor patterns 105*b* and 106*b*. Further, as described below, in this embodiment, also the board 101 made of metal constitutes a part of an electric circuit in which the electric current flows so as to cause the heating element 102 to generate heat.

In FIGS. 1B and 1C, the power supplying electrodes 105*a* and 106*a* and the conductor patterns 105*b* and 106*b* include silver (Ag), platinum (Pt), gold (Au), silver and platinum alloy (Ag—Pt), silver and palladium alloy (Ag—Pd), and the like as the conductive component. Similar to the heating resistor paste for the heating element 102, the power supplying electrodes 105*a* and 106*a* and the conductor patterns 105*b* and 106*b* are each formed by printing and thereafter calcinating a paste mixed with (A) a conductive component, (B) a glass component, and (C) an organic binder component.

The power supplying electrode 105*a* and the conductor pattern 105*b* are formed on the insulating layer 103. The power supplying electrode 105*a* serves as a first power supplying electrode electrically connected to the heating element 102. Extending in the longitudinal direction X on the insulating layer 103, the conductor pattern 105*b* electrically connects the power supplying electrode 105*a* and a first end of the heating element 102 to each other, and is covered at least partially by the protective layer 104. On the other hand, the power supplying electrode 105*a* is exposed at least partially from the protective layer 104 so that the power supplying electrode 105*a* can be connected to a power circuit (drive circuit), described later. The power supplying electrode 105*a* and the conductor pattern 105*b* serve as a first conductive part to energize the heating element 102.

The power supplying electrode 106*a*, which serves as a second power supplying electrode electrically connected to the board 101, is directly formed on the board 101. The power supplying electrode 106*a* is exposed at least partially from the protective layer 104 so that the power supplying electrode 106*a* can be connected to the power circuit, described later. In this embodiment, two power supplying electrodes 105*a* and 106*a* are disposed on the same side in the longitudinal direction X of the heating element 102 (i.e., right side of the heating element 102 in FIG. 1B), and on the same side as the heating element 102 in the thickness direction Z (i.e., upper side of the board 101 in FIG. 1C). Further, in the longitudinal direction X, two power supplying electrodes 105*a* and 106*a* and the conductor pattern 105*b* are positioned outside an area in which the heating element 102 is disposed. The power supplying electrode 106*a* serves as a connecting portion connected to the power circuit with the first conductive part so as to energize the heating element 102.

The conductor pattern 106*b* extends in the longitudinal direction X along a surface of the insulating layer 103 from a second end opposite to the first end of the heating element 102 in the longitudinal direction X, and, bending along an end of the insulating layer 103 in the longitudinal direction X, is connected to the board 101 (refer to FIG. 1C). That is, the conductor pattern 106*b* serves as a conductive portion (or, second conductive part) electrically connecting the heating element 102 and the electrically conductive board 101 to each other. Further, in the longitudinal direction X, the conductor pattern 106*b* is positioned outside the area in which the heating element 102 is disposed.

Since the power supplying electrodes 105*a* and 106*a* and the conductor patterns 105*b* and 106*b* are members through which the electric current flows to supply an electricity to the heating element 102, volume resistances are all set at sufficiently low in comparison with the heating element 102.

For the heating resistor paste, the paste for forming the power supplying electrode 105*a* and 106*a*, and the paste for forming the conductor pattern 105*b* and 106*b*, described above, it is necessary to choose a material which softens and melts at a temperature below a melting point of the board 101 and has the heat resistance in view of the actual use temperature. Further, it is acceptable to mix a glass filler and the like in the power supplying electrode 106*a* and the conductor pattern 106*b* depending on required adhesion strength to the board 101.

While a forming method of the insulating layers 103 and 105, the protective layer 104, the power supplying electrodes 105*a* and 106*a*, and the conductor patterns 105*b* and 106*b* is not particularly limited, as an example, it is possible to smoothly perform formation by a screen printing method and the like. In addition, it is acceptable to perform the formation using a vapor deposition method and the like.

Heater Drive Circuit

Figure 2:
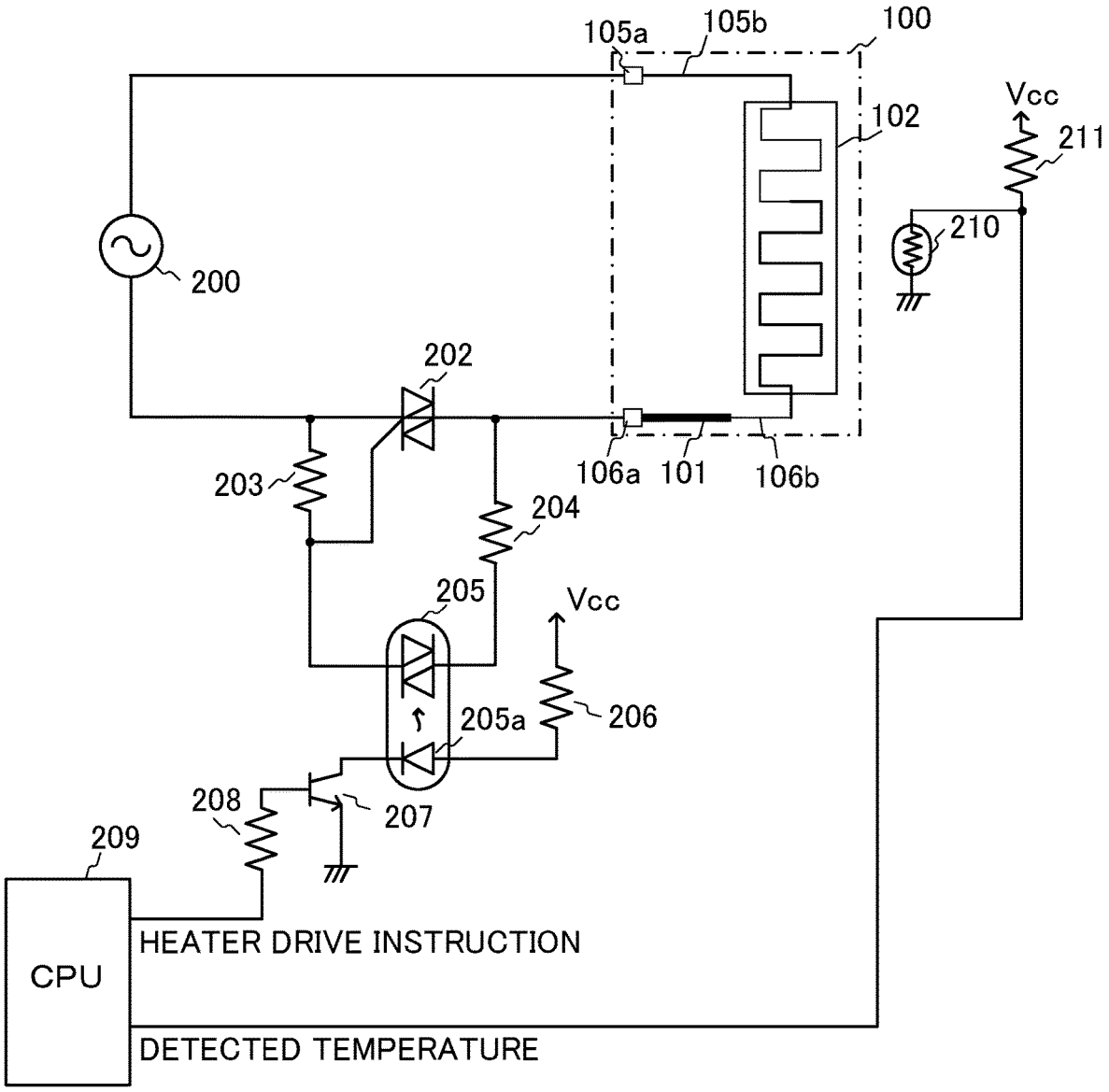
FIG. 2 is diagram showing a drive circuit of the heater according to the first embodiment.

FIG. 2 shows a configuration example of a drive circuit of the heater 100 of this embodiment. As shown in the figure, by connecting the heater 100 to a commercial alternating current power source 200, serving as a power source, it is possible to supply a source voltage to the heating element 102, and generate the heat at the heating element 102. At this time, power supply to the heating element 102 is performed via the power supplying electrodes 105*a* and 106*a*, the conductor patterns 105*b* and 106*b*, and the board 101 of the heater 100.

Further, it is possible to control an amount of heat generated by the heater 100 by energizing and shutting off the electricity to the heating element 102 by energizing/shutting off of a triac 202 disposed between the source voltage and the power supplying electrode 106*a*. Both of resistors 203 and 204 are bias resistors for the triac 202, and a phototriac coupler 205 is a device to control the triac 202 while securing an insulation between the primary side and the secondary side of the circuit.

A CPU (central processing unit) 209 controls the triac 202 based on a temperature detected by a thermistor 210, serving as a temperature detection element, so as to, for example, bring a temperature close to a preset target temperature. In particular, a change in a resistance value of the thermistor 210 in response to a temperature change is detected as a change in a partial voltage between the thermistor 210 and a resistor 211, and is input to the CPU 209 as temperature information (i.e., detected temperature signal) converted into a digital value by A/D (analog to digital) conversion. The CPU 209 outputs a heater drive instruction signal based on the input detected temperature signal. The heater drive instruction signal is input to a transistor 207 via a resistor 208, and the phototriac coupler 205 is turned ON and OFF by the transistor 207. Then, by energizing/shutting off of the triac 202 in accordance with lighting/extinction of a light emitting diode 205*a*, the energizing/shutting off of the heater 100 is performed. To be noted, a resistor 206 is a resistor to regulate an electric current of the light emitting diode 205*a*.

To be noted, the drive circuit shown here is an example, and it is acceptable to function the heater 100 by connecting a drive circuit with a different circuit configuration to the power supplying electrodes 105*a* and 106*a*.

Comparison of First Embodiment and Comparative Example

So as to describe an advantage of this embodiment, this embodiment will be described while comparing with a heater 300 of a comparative example shown in FIGS. 3A to 3C.

Figure 3A:
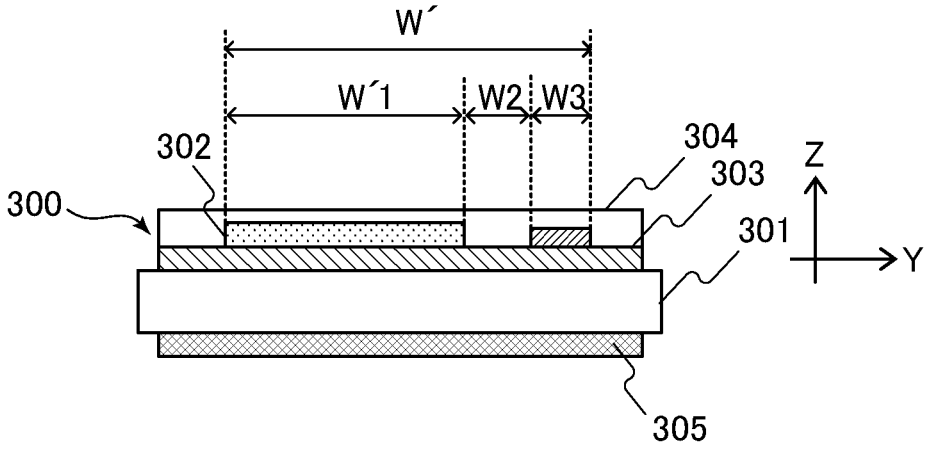
FIGS. 3A, 3B, and 3C are respectively a cross-sectional view in a short direction, a plan view, and a cross-sectional view in a longitudinal direction of a heater according to a comparative example.

As shown in FIG. 3A, the heater 300 of the comparative example includes, similar to this embodiment, a board 301 made of metal, a heating element 302 generating the heat by passing an electric current therethrough, an insulating layer 303 insulating the board 301 and the heating element 302 from each other, and a protective layer 304 protecting the heating element 302. Further, so as to prevent a warpage of a base material for the board 301 at manufacturing, an insulating layer 305 is included also on a surface of the board 301 opposite to the surface on which the heating element 302 is disposed.

Figure 3B:
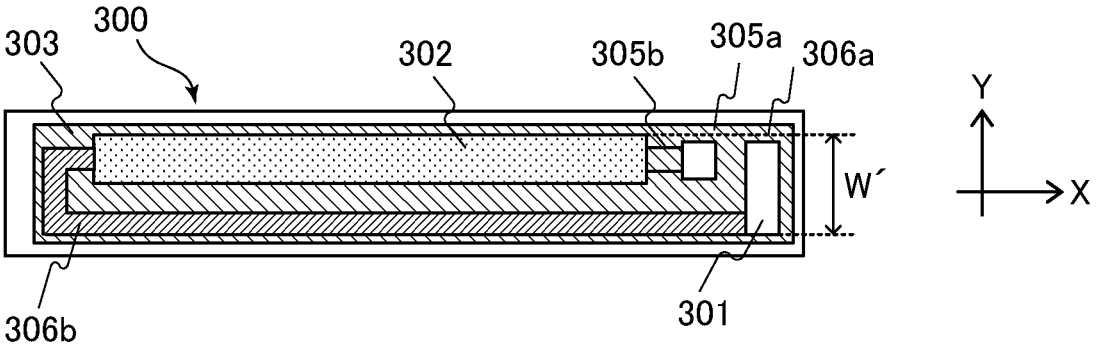
Figure 3C:
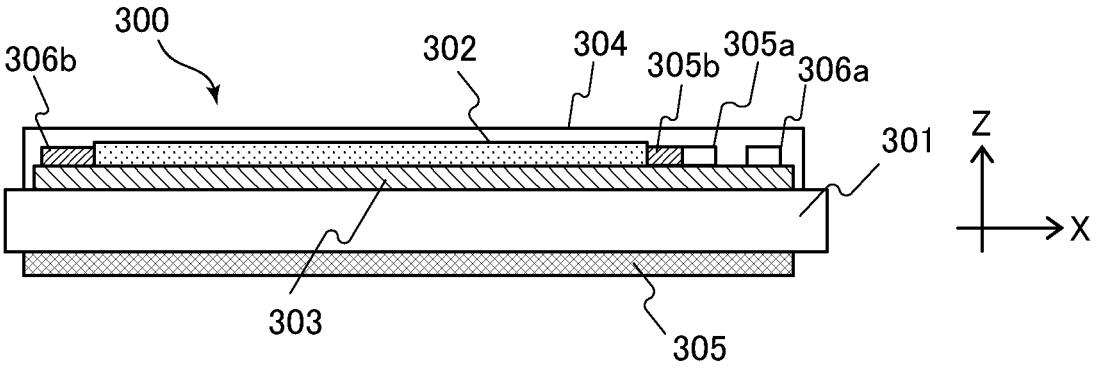

A difference from this embodiment is that, as shown in FIGS. 3B and 3C, in the comparative example, all of the power supplying electrode 306*a* and the conductor pattern 306*b* are printed and calcinated on the insulating layer 303. That is, in the comparative example, a heater circuit (i.e., an electric circuit consisting of the heating element 302, the power supplying electrodes 305*a* and 306*a*, and the conductor patterns 305*b* and 306*b*) to supply the electricity to the heating element 302 is all disposed on the insulating layer 303. Since the board 301 is insulated from the heater circuit by the insulating layer 303, even if the power supplying electrodes 305*a* and 306*a* are connected to the source voltage, the electric current does not flow to the board 301.

At this point, as shown in FIG. 1A, a short width W of a circuit layout area on the board 101 of this embodiment is equal to a short width W1 which is the maximum width of the heating element 102 in the short direction Y, and expressed by an equation (1) below.

$$W = W1 \tag{1}$$

Note that a circuit layout area means a necessary area on the board 101, when viewed in the thickness direction Z, so as to mount the heater circuit, and the short width W is the maximum width of the circuit layout area in the short direction Y.

On the other hand, a short width W' of a circuit layout area on the board 301 of the comparative example is expressed by an equation (2) below. Note that W'1 indicates the maximum width of the heating element 302 in the short direction Y, W2 indicates the maximum width of the conductor pattern 306*b* in the short direction Y, and W3 indicates a necessary distance between the heating element 302 and the conductor pattern 306*b* for manufacturing.

$$W' = W'1 + W2 + W3 \quad (2)$$

In a case where the short widths W1 and W'1 in this embodiment and the comparative example are equal, the short width of the circuit layout area of this embodiment will be smaller than the short width of the circuit layout area of the comparative example by (W2+W3). This is because, although the conductor pattern 306*b* is disposed alongside the heating element 302 in the short direction Y in the comparative example, in this embodiment, the metal board 101 is utilized as a circuit element substituting a function of the conductor pattern 306*b*. To be noted, in the configuration of the comparative example, miniaturization in the short direction Y by disposing the power supplying electrode 306*a* and the conductor pattern 306*b* on an opposite side of the power supplying electrode 305*a* across the heating element 302 is also considered. However, in a case where the power supplying electrodes 305*a* and 306*a* are far apart from each other, contacts of the power circuit supplying the power to the heater 300 are also brought into far apart positions, and, therefore, it is necessary to provide a wiring space for the contacts so that the miniaturization of a fixing unit in whole is not attained. That is, since, in this embodiment, the power supplying electrodes 105*a* and 106*a* are disposed on the same side as the heating element 102 in the longitudinal direction X (on a right-hand side in FIG. 1B), it is possible to miniaturize a layout of connectors and wiring connected to the power supplying electrodes 105*a* and 106*a*.

Incidentally, if a reduction in the short width W' in the comparative example is intended, it is necessary to reduce W'1 or W3. However, if W'1 or W3 is reduced (narrowing a width of the heating element 302), there is a possibility of breakage due to overheating, or it is necessary to accept a decrease in heat generation performance to prevent the breakage. On the other hand, in this embodiment, since it becomes possible to keep the short width W of the circuit layout area small while securing the short width W1 of the heating element 102, it is possible to compatibly ensure the heat generation performance of the heater 100 and miniaturize the heater 100. Especially, in this embodiment, the power supplying electrodes 105*a* and 106*a*, the heating element 102, and the conductor pattern 106*b* are arranged in a line in the longitudinal direction X, and positions, in the short direction Y, of the power supplying electrodes 105*a* and 106*a*, the heating element 102, and conductor pattern 106*b* overlap each other. The layout as described above is especially effective in compatibly ensuring the heat generation performance of the heater 100 and miniaturizing the heater 100. It is acceptable if the positions of the power supplying electrodes 105*a* and 106*a*, the heating element 102, and the conductor pattern 106*b* in the short direction Y overlap each other at least partially.

To be noted, in the equation (1), it was described that the short width W1 of the heating element 102 is larger than the maximum widths of the power supplying electrode 105*a* and the conductor pattern 105*b* in the short direction Y. Generally, this condition is met so as to prevent the overheating of the heating element 102 generating the heat by the energization. However, even in a case where the width of the power supplying electrode 105*a* or the conductor pattern 105*b* in the short direction Y is larger than the short width W1 of the heating element 102, it is similarly not necessary to dispose such circuit element and the conductor pattern 106*b* alongside in the short direction Y as shown in FIG. 3B. Accordingly, regardless of a width relation between the short width W1 of the heating element 102 and the short widths of the power supplying electrode 105*a* and the conductor pattern 105*b*, it is possible to compatibly ensure the heat generation performance of the heater 100 and miniaturize the heater 100.

Second Embodiment

As a second embodiment, an embodiment in which the heating element and the board are electrically connected to each other through an opening portion disposed in the insulating layer will be described using FIGS. 4A to 4C. Hereinafter, the elements put with the same reference characters as the first embodiment have substantially the same configurations and functions as the first embodiment, and differences from the first embodiment will be mainly described.

Figure 4A:
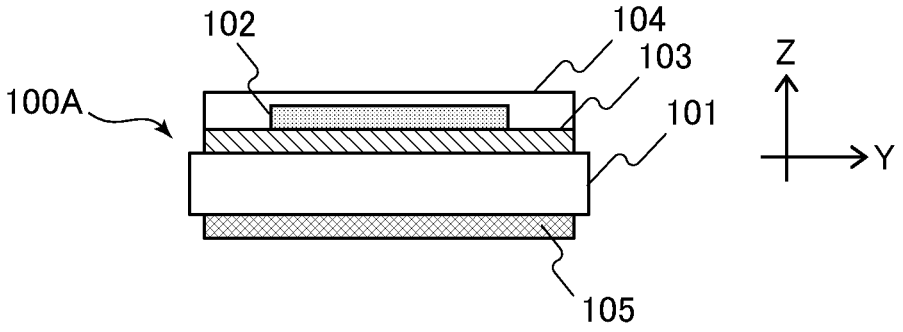
FIGS. 4A, 4B, and 4C are respectively a cross-sectional view in a short direction, a plan view, and a cross-sectional view in a longitudinal direction of a heater according to a second embodiment.

FIG. 4A is a cross-sectional view of a heater 100A of this embodiment taken along a virtual plane spreading in the short direction Y and the thickness direction Z, and viewed in the longitudinal direction X. FIG. 4B is a plan view of the heater 100A, when viewed from a side, in the thickness direction Z, on which the heating element 102 is disposed. FIG. 4C is a cross-sectional view of the heater 100A taken along a virtual plane spreading in the longitudinal direction X and the thickness direction Z, and viewed in the short direction Y.

Figure 4B:
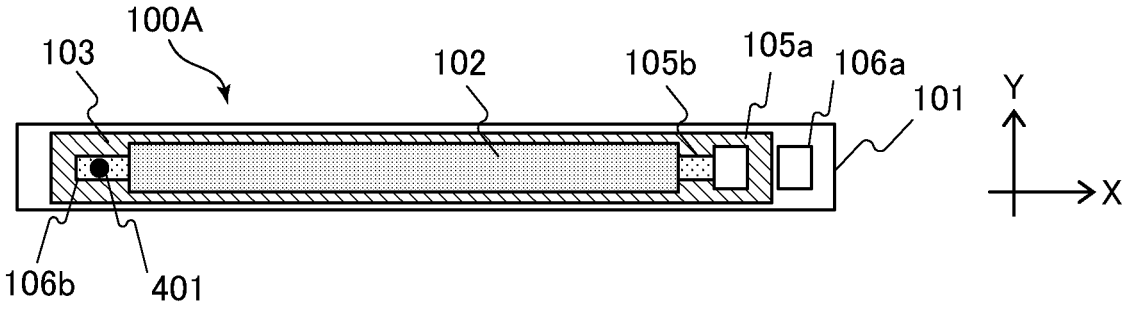
Figure 4C:
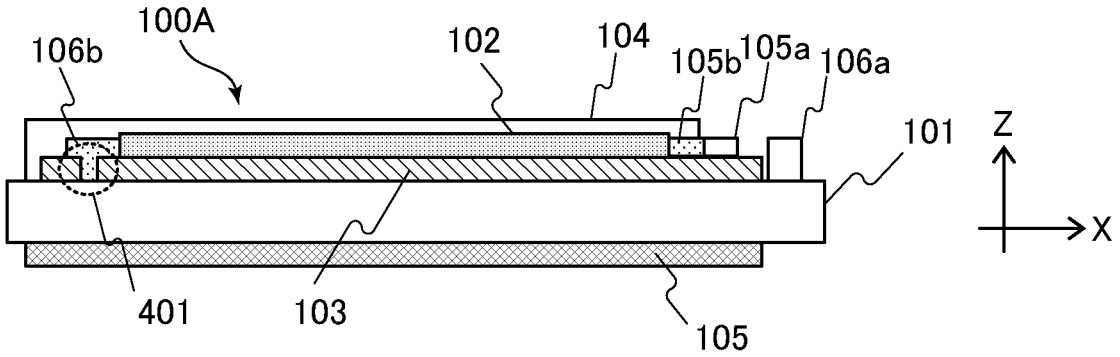

As shown in FIGS. 4B and 4C, different from the first embodiment, the opening portion 401 piercing through from the surface of the insulating layer 103 to the board 101 is disposed inside a periphery of the insulating layer 103 insulating the heating element 102 and the board 101 when viewed in the thickness direction Z. Further, the conductor pattern 106*b*, serving as the second conductive portion, is formed from an end of the heating element 102 in the longitudinal direction X to the board 101 via the opening portion 401. Herewith, the heating element 102 and the board 101, which is electrically conductive, are electrically connected to each other.

At this point, a case where, similar to the first embodiment, the conductor pattern 106*b* (FIG. 4C) bending along the insulating layer 103 is formed by the screen printing method is considered. In this case, since there is a level difference of as much as a thickness of the insulating layer 103 at an end of the insulating layer 103, it is sometimes difficult to secure a sufficient film thickness in the conductor pattern 106*b*. In a case where the film thickness of the conductor pattern 106*b* is insufficient, an occurrence of a conduction failure between the heating element 102 and the board 101 is concerned.

On the other hand, as shown in FIGS. 4A to 4C, by disposing the opening portion 401 in the insulating layer 103 and coating an inside of the opening portion 401 with the paste of the conductor pattern 106*b*, printing formation of the conductor pattern 106*b* becomes easier. Accordingly, without depending on conditions such as the thickness of the insulating layer 103, it is possible to secure the thickness of the conductor pattern 106*b*, and further reduce a possibility of the occurrence of the conduction failure between the heating element 102 and the board 101.

Third Embodiment

As a third embodiment, an embodiment in which a layout of the power supplying electrodes is changed will be described using FIGS. 5A to 5C. Hereinafter, the elements put with the same reference characters as the first and second embodiments have substantially the same configurations and functions as the first and second embodiments, and differences from the first embodiment will be mainly described.

Figure 5A:
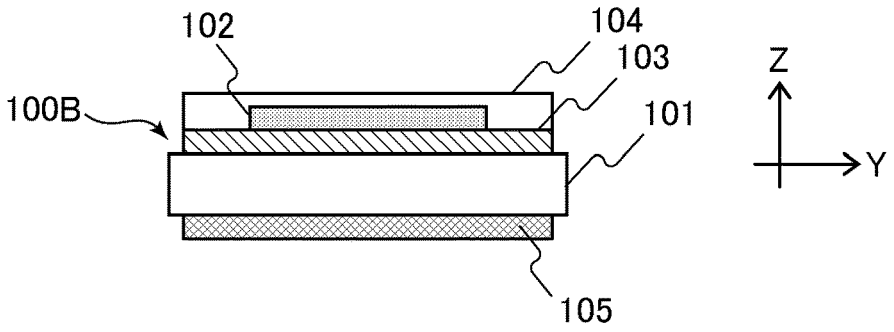
FIGS. 5A, 5B, and 5C are respectively a cross-sectional view in a short direction, a plan view, and a cross-sectional view in a longitudinal direction of a heater according to a third embodiment.

FIG. 5A is a cross-sectional view of a heater 100B of this embodiment taken along a virtual plane spreading in the short direction Y and the thickness direction Z, and viewed in the longitudinal direction X. FIG. 5B is a plan view of the heater 100B, when viewed from a side, in the thickness direction Z, on which the heating element 102 is disposed. FIG. 5C is a cross-sectional view of the heater 100B taken along a virtual plane spreading in the longitudinal direction X and the thickness direction Z, and viewed in the short direction Y.

Figure 5B:
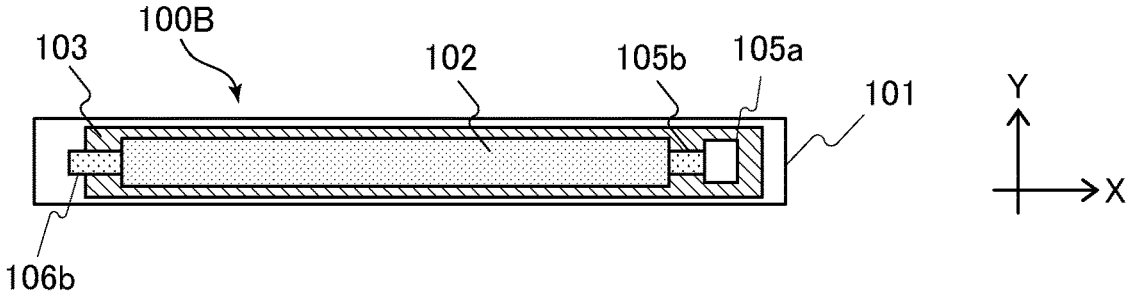
Figure 5C:
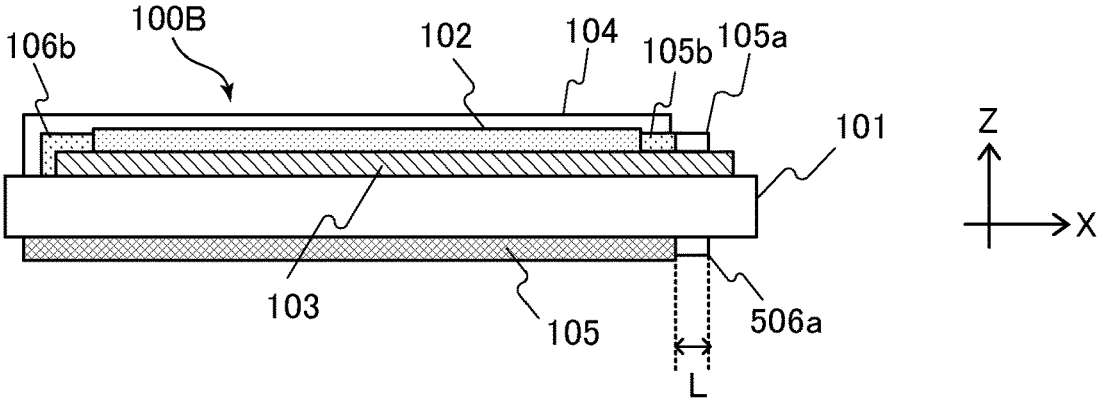

As shown in FIGS. 5B and 5C, in this embodiment, different from the first and second embodiments, a power supplying electrode 506*a* (connecting portion) that is connected to the board 101 is disposed on a surface (i.e., second surface) different from the surface (i.e., first surface, upper surface in FIGS. 5A and 5C) on which the heating element 102 of the heater 100B is disposed. In a configuration example shown in FIGS. 5A to 5C, the power supplying electrode 506*a* is disposed on an opposite side, in the thickness direction Z, of the surface on which the heating element 102, the power supplying electrode 105*a*, and the conductor patterns 105*b* and 106*b* are disposed.

At this point, in the configurations of the first and second embodiments shown in FIGS. 1B and 1C and FIGS. 4B and 4C, the power supplying electrode 106*a* is disposed on the same surface as the surface on which the heating element 102, the power supplying electrode 105*a*, and the conductor patterns 105*b* and 106*b* are disposed. Therefore, the power supplying electrode 106*a* is disposed in a line in the longitudinal direction X with these circuit elements, accepting that the width of the circuit layout area in the longitudinal direction X is enlarged by the width of the power supplying electrode 106*a* in the longitudinal direction X.

On the other hand, in this embodiment, the power supplying electrode 506*a* is disposed on the different surface from the surface on which the heating element 102, the power supplying electrode 105*a*, and the conductor patterns 105*b* and 106*b* are disposed. Therefore, it is possible to overlap a position of the power supplying electrode 506*a* in the longitudinal direction X (FIG. 5C) with, for example, the position of the power supplying electrode 105*a* in the longitudinal direction X. Accordingly, by the configuration of this embodiment, a required length of the board 101 in the longitudinal direction X can be reduced at least by the maximum width L of the power supplying electrode 506*a* in the longitudinal direction X, and it is possible to further miniaturize the heater 100B.

To be noted, while, in this embodiment, the power supplying electrode 506*a* is disposed on the surface of the board 101 opposite to the heating element 102 and the power supplying electrode 105*a* in the thickness direction Z, it is acceptable to dispose the power supplying electrode 506*a* on a further different surface (for example, on a side surface in the short direction Y).

Fourth Embodiment

As a fourth embodiment, a fixing unit 600 including the heater 100 described in the first embodiment will be described using FIGS. 6 and 7. Hereinafter, the elements put with the same reference characters as the first embodiment have substantially similar configurations and functions to the first embodiment.

Figure 6:
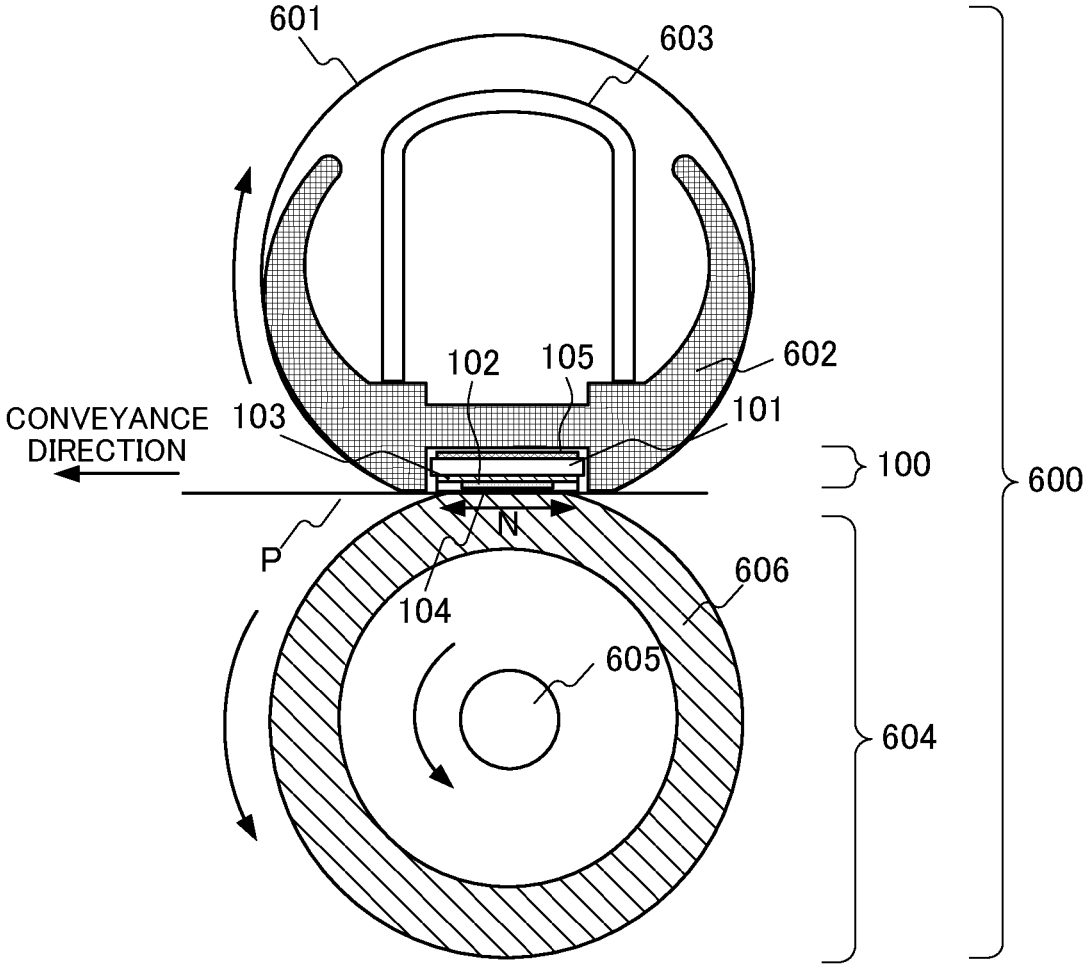
FIG. 6 is a cross-sectional view of a fixing unit according to a fourth embodiment.

The fixing unit 600 shown in FIG. 6 is an image heating unit of the heat fixing type which fixes a toner image transferred onto a recording material P on the recording material P by heating at a nip portion. The fixing unit 600 includes a tubular film 601, which is a fixing member, the heater 100 disposed in an internal space of the film 601, a holding member 602 holding the heater 100, and a pressing roller 604, which is a pressing member. The heater 100 held by the holding member 602 and the pressing roller 604 facing the heater 100 come into pressure contact with each other across the film 601, and herewith the nip portion N is formed. That is, the heater 100 and the holding member 602 function as a nip portion forming unit in this embodiment.

The film 601 is a heat resistance film formed into a tubular shape, which is also called an endless belt or an endless film, and at least includes a base layer. A material for the base layer is a heat resistance resin such as polyimide or metal such as stainless steel. Further, it is acceptable to dispose an elastic layer such as a heat resistance rubber on a surface of the film 601. The pressing roller 604 includes a core metal 605 made of iron, aluminum, and the like and an elastic layer 606 made of a silicone rubber and the like.

The heater 100 is held by the holding member 602 made of a heat resistance resin. In the illustrated configuration example, the heater 100 is disposed so that the longitudinal direction X of the heater 100 is substantially parallel to rotational axis directions of the film 601 and the pressing roller 604 and the short direction Y is approximately parallel to the conveyance direction of the recording material P at the nip portion N. Further, with respect to the thickness direction Z, the heater 100 is disposed so that a surface (i.e., surface of the protective layer 104) of the heater 100 on a side on which the heating element 102 is disposed, comes into contact with an inner surface of the film 601.

The holding member 602 also includes a guide function guiding rotation of the film 601. The holding member 602 is applied a downward urging force in the figure from a stay 603 fixed to a frame member of the fixing unit 600 by a spring, not shown. Pressure to press the toner image at the nip portion N is generated by this urging force of the spring.

The pressing roller 604 receives a power from a drive source, not shown, and rotates counter-clockwise in the figure. By the rotation of the pressing roller 604, the film 601 is rotatably driven clockwise in the figure. Further, before the recording material P with the toner image formed has reached the nip portion N, the energization of the heater 100 is started, and a temperature at the nip portion N is maintained at a target temperature suitable for the heat fixing during a passage of the recording material P through the nip portion N.

Figure 7:
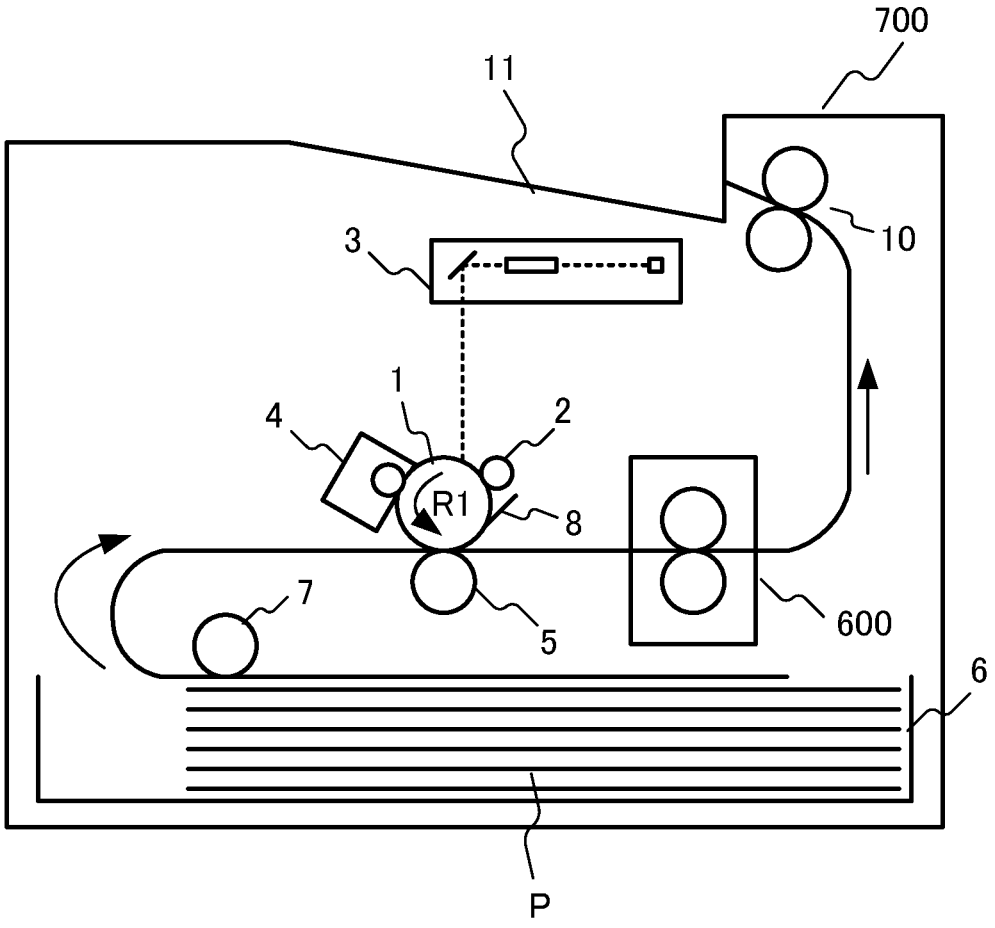
FIG. 7 is a schematic view of an image forming apparatus according to the fourth embodiment.

FIG. 7 shows a laser beam printer (hereinafter simply referred to as a printer 700) adopting an electrophotographic system as an example of the image forming apparatus. When the printer 700 has received an execution instruction of the image forming operation, a scanner unit 3 irradiates a photosensitive member 1, serving as an image bearing member, with a laser beam in accordance with image information. By scanning a surface of the photosensitive member 1, which has been charged in a predetermined polarity by a charge roller 2 beforehand, with the laser beam, an electrostatic latent image is formed on the surface of the photosensitive member 1 in accordance with the image information. Thereafter, a developing unit 4 supplies a toner to the photosensitive member 1, and the electrostatic latent image is developed and visualized as a toner image.

By rotation of the photosensitive member 1 in an arrow R1 direction, the toner image carried on the photosensitive member 1 reaches a transfer nip, serving as a transfer portion. The transfer nip is a nip portion formed between the photosensitive member 1 and a transfer roller 5, serving as a transfer unit. By applying a voltage to the transfer roller 5, the toner image is transferred to the recording material P sent from a cassette 6 by a pickup roller 7. The surface, which has passed through the transfer nip, of the photosensitive member 1 is cleaned by a cleaner 8. The recording material P with the toner image transferred is conveyed to the fixing unit 600.

Then, the fixing unit 600 shown in FIG. 6 performs a fixing process in which the toner image on the recording material P is provided with the heat and pressure at the nip portion N, while nipping and conveying the recording material P. Herewith, the toner is melted and thereafter cooled and solidified so that a fixed image fixed on the recording material P is obtained.

The recording material P passed through the fixing unit 600 is discharged to a tray 11 by a sheet discharge roller 10 (FIG. 7). To be noted, for the recording material P, it is possible to use various kinds of sheets different in sizes and materials including, but not limited to, a paper such as a standard paper and a cardboard, a plastic film, a cloth, various kinds of sheet materials applied with a surface treatment such as a coated paper, and a specially shaped sheet such as an envelope and an index paper. Further, while a direct transfer system directly transferring the toner image from the photosensitive member 1 to the recording material P is described in this description, it is acceptable to apply a technique described below to an image forming apparatus which transfers the toner image formed on the image bearing member to the recording material via an intermediate transfer member such as an intermediate transfer belt. In that case, a transfer mechanism including a primary transfer member primarily transferring the toner image from the image bearing member to the intermediate transfer member and a secondary transfer member secondarily transfer the toner image from the intermediate transfer member to the recording material serves as the transfer unit.

As described above, by using the heater 100 of this embodiment for the fixing unit 600, it is possible to miniaturize the fixing unit 600 and, furthermore, the printer 700.

To be noted, it is acceptable to use the heaters 100A and 100B of the second and third embodiments for the fixing unit 600 in place of the heater 100 of the first embodiment. Further, it is not limited to the configuration example shown in FIG. 6, and acceptable to dispose in a configuration in which an opposite side (the side of the insulating layer 105), in the thickness direction Z, of the surface on which the heating element 102 of the heater 100 is disposed comes into contact with the inner surface of the film 601.

Further, while the heater 100 directly comes into contact with the inner surface of the film 601 in the fixing unit 600 of FIG. 6, it is acceptable to dispose a plate shaped or sheet shaped member having a high heat conductivity (for example, sheet shaped member made of ferroalloy and aluminum) between the heater 100 and the inner surface of the film 601. That is, it is acceptable to use a nip portion forming unit in which the heater 100 is configured to heat the film via a sliding member sliding along the inner surface of the film 601.

OTHER EMBODIMENTS

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-112790, filed on Jun. 30, 2020, which is hereby incorporated by reference herein in its entirety.

What is claimed is:

1. A heating unit comprising:

a board including metal;

an insulating layer including insulating material and formed on a surface of the board;

a heating element disposed on the insulating layer and configured to generate heat by passing an electric current through the heating element;

a first conductive portion electrically connecting the heating element and the board to each other;

a first power supplying electrode electrically connected to the heating element;

a second conductive portion disposed on the insulating layer and configured to electrically connect the first power supplying electrode and the heating element to each other; and a second power supplying electrode electrically connected to the board, wherein the heating element, the first conductive portion, the second conductive portion and the board constitute an electric circuit between the first power supplying electrode and the second power supplying electrode, and wherein the heating element is configured to generate the heat in a case where the first power supplying electrode and the second power supplying electrode are electrically connected to a power source and the electric current is passed through the electric circuit.

2. The heating unit according to claim 1, wherein the heating element extends along a longitudinal direction of the board, wherein the first power supplying electrode is connected to a first end of the heating element in the longitudinal direction, and wherein the first conductive portion is connected to a second end opposite to the first end of the heating element in the longitudinal direction.

3. The heating unit according to claim 2, wherein the first power supplying electrode, the second power supplying electrode, the heating element, and the first conductive portion are arranged in a line in the longitudinal direction, and wherein in terms of positions in a direction perpendicular to the longitudinal direction and along the surface of the board, positions of the first power supplying electrode, the second power supplying electrode, the heating element and the first conductive portion overlap each other.

4. The heating unit according to claim 2, wherein the first power supplying electrode and the second power supplying electrode are disposed on a same side of the heating element in the longitudinal direction.

5. The heating unit according to claim 1, wherein the first conductive portion is arranged to connect the heating element and the board to each other via an end of the insulating layer in a longitudinal direction of the board.

6. The heating unit according to claim 1, wherein an opening portion configured to expose the board is formed in the insulating layer, and wherein the first conductive portion is configured to connect the heating element and the board to each other via the opening portion.

7. The heating unit according to claim 1, wherein the first power supplying electrode is disposed on the insulating layer, and wherein the second power supplying electrode is disposed within an area of the surface of the board, where the area is an area in which the insulating layer is not disposed.

8. The heating unit according to claim 1, wherein the first power supplying electrode is disposed on the insulating layer, wherein the surface of the board on which the insulating layer is formed is a first surface, and wherein the second power supplying electrode is disposed on a second surface of the board different from the first surface.

9. A fixing unit comprising:

a tubular film;

a heating unit having:

a board including metal, an insulating layer including insulating material and formed on a surface of the board, a heating element disposed on the insulating layer and configured to generate heat by passing an electric current through the heating element, a first conductive portion electrically connecting the heating element and the board to each other, a first power supplying electrode electrically connected to the heating element, a second conductive portion disposed on the insulating layer and configured to electrically connect the first power supplying electrode and the heating element to each other, and a second power supplying electrode electrically connected to the board, wherein the heating element, the first conductive portion, the second conductive portion and the board constitute an electric circuit between the first power supplying electrode and the second power supplying electrode, and wherein the heating element is configured to generate the heat in a case where the first power supplying electrode and the second power supplying electrode are electrically connected to a power source and the electric current is passed through the electric circuit;

a nip portion forming unit disposed inside the tubular film, wherein the nip portion forming unit includes the heating unit and a holding member configured to hold the heating unit; and a pressing member facing the nip portion forming unit across the tubular film, and configured to form a nip portion between the tubular film and the pressing member, wherein, in a case where an image is borne on a recording material, the fixing unit fixes the image on the recording material by heating, through the tubular film heated by the heating unit, the image borne on the recording material.

10. An image forming apparatus comprising:

an image bearing member configured to rotate;

a transfer unit configured to transfer a toner image from the image bearing member to a recording material; and the fixing unit according to claim 9 configured to fix the toner image transferred to the recording material by the transfer unit on the recording material.

* * * * *